US006679711B2

(12) United States Patent
Takahashi

(10) Patent No.: US 6,679,711 B2
(45) Date of Patent: Jan. 20, 2004

(54) LEVER TYPE CONNECTOR

(75) Inventor: Toshiharu Takahashi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/201,931

(22) Filed: Jul. 25, 2002

(65) Prior Publication Data

US 2003/0022539 A1 Jan. 30, 2003

(30) Foreign Application Priority Data

Jul. 25, 2001 (JP) ..... P2001-224949

(51) Int. Cl.[7] ..... H01R 13/62
(52) U.S. Cl. ..... 439/157; 439/153
(58) Field of Search ..... 439/157, 153, 439/372

(56) References Cited

U.S. PATENT DOCUMENTS 5,611,703 A * 3/1997 Okamoto et al. ..... 439/157
5,709,560 A * 1/1998 Hio ..... 439/157
6,030,235 A * 2/2000 Ittah et al. ..... 439/157

FOREIGN PATENT DOCUMENTS

JP 8-180930 7/1996
JP 9-147973 6/1997

* cited by examiner

*Primary Examiner*—Tho D. Ta
(74) *Attorney, Agent, or Firm*—Sughrue Mion, PLLC

(57) ABSTRACT

A lever type connector includes a first housing and a second housing. A lever is provided on the second housing so as to be pivotable between a first position and a second position. The lever includes a pair of lever bodies and a lever connecting portion connecting the pair of lever bodies. A lever retainer is provided on the second housing to retain the lever at the second position. A first boss is provided on at least one of the lever connecting portion and the lever retainer. The first housing and the second housing are fitted with each other in a leverage manner when the lever is pivoted toward the second position. At least one of the lever connecting portion and the lever retainer is flexed by the first boss in a state that the lever is retained on the lever retainer when the first housing and the second housing are completely engaged.

10 Claims, 10 Drawing Sheets

LEVER TYPE CONNECTOR

BACKGROUND OF THE INVENTION

This invention relates to a lever type connector, and more particularly to a lever type connector in which female and male connectors can be easily fitted together with a low insertion force by pivotally moving a lever having no spring.

There is known a related lever type connector, having no spring, in which female and male connectors can be easily fitted together with a low insertion force by pivotally moving a lever having no spring.

In this lever type connector 1, for example, the lever 10 is pivotally mounted on outer walls of a female connector housing 2, as shown in FIG. 10. The female connector housing 2 has a plurality of terminal receiving chambers 3 open to the front side thereof, and its outside is covered with a hood portion 4 which forms a housing-fitting space 5 for receiving a mating male connector housing therein. A pair of boss guide grooves 6 for respectively guiding male lever engagement bosses 21 (see FIG. 13) of the male connector housing (described later) are formed respectively in opposite side walls of the hood portion 4, and are open respectively to front ends of these opposite side walls.

A pair of female lever engagement bosses 7 are formed respectively on opposite side walls of the female connector housing 2. Provisionally-retaining portions 9 for provisionally retaining one end of the lever 10 before fitting the two connectors together are formed respectively on these opposite side walls, and are disposed near respectively to the female lever engagement bosses 7.

Further, a lever lock portion 8 for retaining the lever 10, pivotally moved to completely fit the two connectors together, is provided at a rear end portion of the female connector housing 2.

The lever 10 includes lever bodies 11, each having a lever engagement hole 13 for fitting on the corresponding female lever engagement boss 7 of the female connector housing 2, and a pivotal movement-operating portion 12 interconnecting the lever bodies 11. A lever groove portion 14 for guiding the corresponding male lever engagement boss during the pivotal movement of the lever is formed in each lever body 11.

A pair of housing lock portions 16 for retaining engagement with the lever lock portion 8 are formed in a projected manner on a central portion of a contact face 15 of the pivotal movement-operating portion 12.

As shown in FIG. 11, each female lever engagement boss 7 projects outwardly from the lever engagement hole 13 in the lever body 11 of the lever 10, and the lever 10 can be pivotally moved about the female lever engagement bosses 7.

As shown in FIG. 12, the inner peripheral face of the lever engagement hole 13 (in the lever body 11), disposed in contact with the female lever engagement boss 7, is defined only by a wall thickness t0 of the lever body 11.

Next, the operation during the fitting connection between the female and male connectors of the lever type connector 1 will be described.

The fitting sides of the female and male connector housings 2 and 20 are opposed to each other, and the male lever engagement bosses 21 of the male connector housing 20 are inserted respectively into the boss guide grooves 6, and are slidably engaged respectively in the lever groove portions 14 in the lever 10, as shown in FIG. 13.

Then, the pivotal movement-operating portion 12, indicated in imaginary lines, is gripped, and is pivotally moved about the female lever engagement bosses 7 toward the lever lock portion 8 (in a direction of an arrow A in the drawing), so that the lever 10 in a provisionally-retained condition is disengaged from the provisionally-retaining portions 9. In accordance with this pivotal movement, each male lever engagement boss 21 moves toward the inner end of the lever groove portion 14, and also moves toward the inner end of the boss guide groove 6 in the female connector housing 2.

In accordance with this movement of the male lever engagement bosses 21, the male connector housing 20 is inserted and fitted into the housing-fitting space 5 in the female connector housing 2, and therefore the fitting of the female and male connector housings 2 and 20 relative to each other proceeds.

Then, the contact face 15 of the pivotal movement-operating portion 12 of the lever 10 brings into contact with the lever lock portion 8 as shown in FIG. 13, and the housing lock portions 16 (see FIG. 10) are retained by this lever lock portion, so that the female and male connector housings 2 and 20 are completely fitted together.

In the above related lever type connector 1 having no spring, a reaction force is not produced by a spring when the two connectors are completely fitted together, and therefore a gap G is formed between the contact face 15 of the lever 10 and the lever lock portion 8 as shown in FIG. 14.

As a result of the formation of this gap G, the lever 10 is moved upon application of vibrations, which incurs a problem that each female lever engagement boss 7 (see FIGS. 11 and 12) of the female connector housing 2 is cut or shaved by the edge of the lever engagement hole 13 during the sliding movement.

And besides, each male lever engagement boss 21 of the male connector housing 20 bring into contact with the lever groove portion 14 of the lever 10, and therefore a relative slight sliding movement occurs between contact portions of mating terminals, contacted with each other, and this incurs a problem that plating films on these contact portions are scraped, so that the contact resistance regarding the contact portions increases.

A further problem is that the operability for releasing the retained condition of the lever is not good since a reaction force of a spring is not obtained.

SUMMARY OF THE INVENTION

It is therefore an object of the present invention to provide an male connector terminal, in which the jolting is eliminated after female and male connectors are fitted together, and the operability for releasing a retained condition of a lever is enhanced.

In order to achieve the above object, according to the present invention, there is provided a lever type connector comprising:

- a first housing;
- a second housing;
- a lever, provided on the second housing so as to be pivotable between a first position and a second position, the lever includes a pair of lever bodies and a lever connecting portion connecting the pair of lever bodies;
- a lever retainer, provided on the second housing to retain the lever at the second position; and
- a first boss, provided on at least one of the lever connecting portion and the lever retainer;

wherein the first housing and the second housing are fitted with each other in a leverage manner when the lever is pivoted toward the second position; and wherein at least one of the lever connecting portion and the lever retainer is flexed by the first boss in a state that the lever is retained on the lever retainer when the first housing and the second housing are completely engaged.

In this configuration, when the first and second housings are completely fitted together, the lever is retained by the lever retainer at the second position, and also at least one of the lever connecting portion and the lever retainer is flexed by the first boss.

Therefore, the lever can be retained with a suitable urging force even without the use of any spring. And besides, the first boss exists in a gap between the lever connecting portion and the lever retainer of the second housing, and therefore the jolting due to vibrations and the like can be positively prevented.

Furthermore, when releasing the lever from the retained condition at a second position, the lever is sprung up by the resilient force of the elastically-deformed at least one of the lever connecting portion and the lever retainer, and therefore the operability for releasing the retained condition of the lever can be enhanced.

Preferably, the lever style connector further comprising;

a second boss formed on each of both side walls of the second housing; and wherein each of the lever bodies has a first engagement hole; and wherein each of the lever bodies has a cylindrical supporting portion formed around the first engagement hole so as to cover a peripheral wall of the second boss protruded outwardly through the first engagement hole.

In this configuration, the second boss of the second housing is rotatably fitted in the first engagement hole in the cylindrical supporting portion in such a manner that the second boss does not project outwardly from the cylindrical supporting portion. Therefore, the contact area between the second boss and the first engagement hole is increased, and the cutting or shaving of the second boss due to slight pivotal movement of the lever, caused by vibrations and the like, can be positively prevented.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of a lever type connector of the present invention will now be described with reference to FIGS. 1 to 9.

Figure 1:
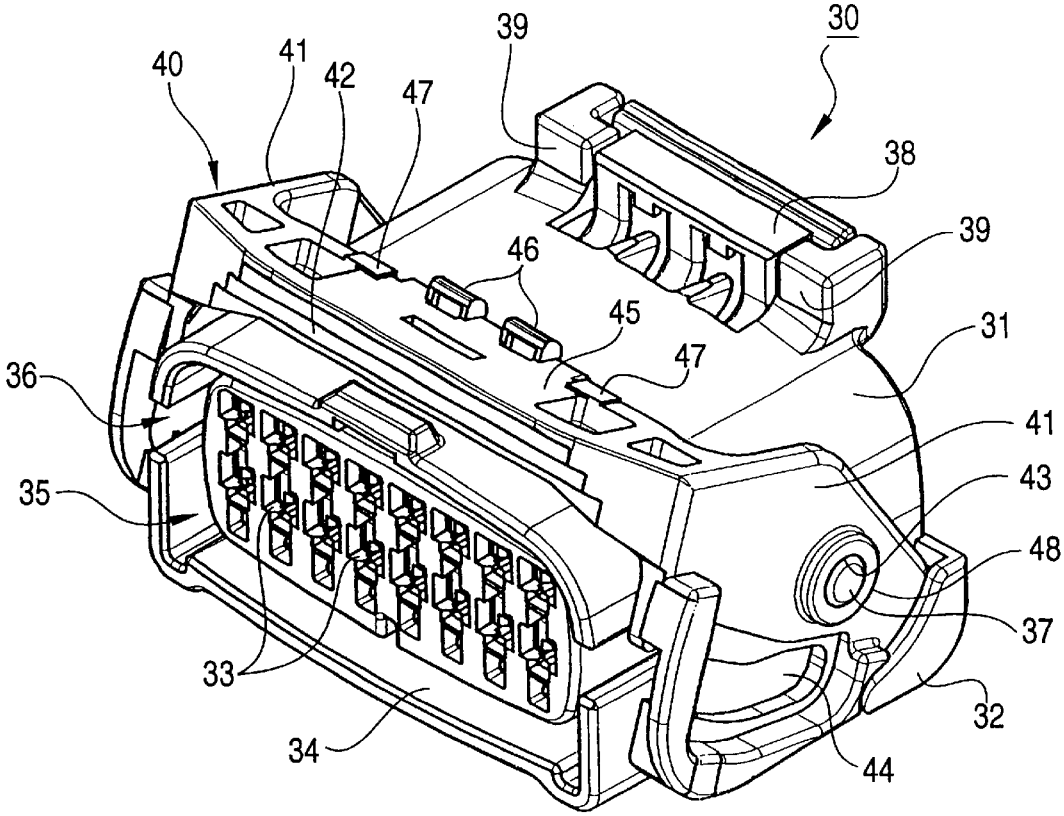
FIG. 1 is a perspective view showing one preferred embodiment of a lever type connector of the present invention.
Figure 2:
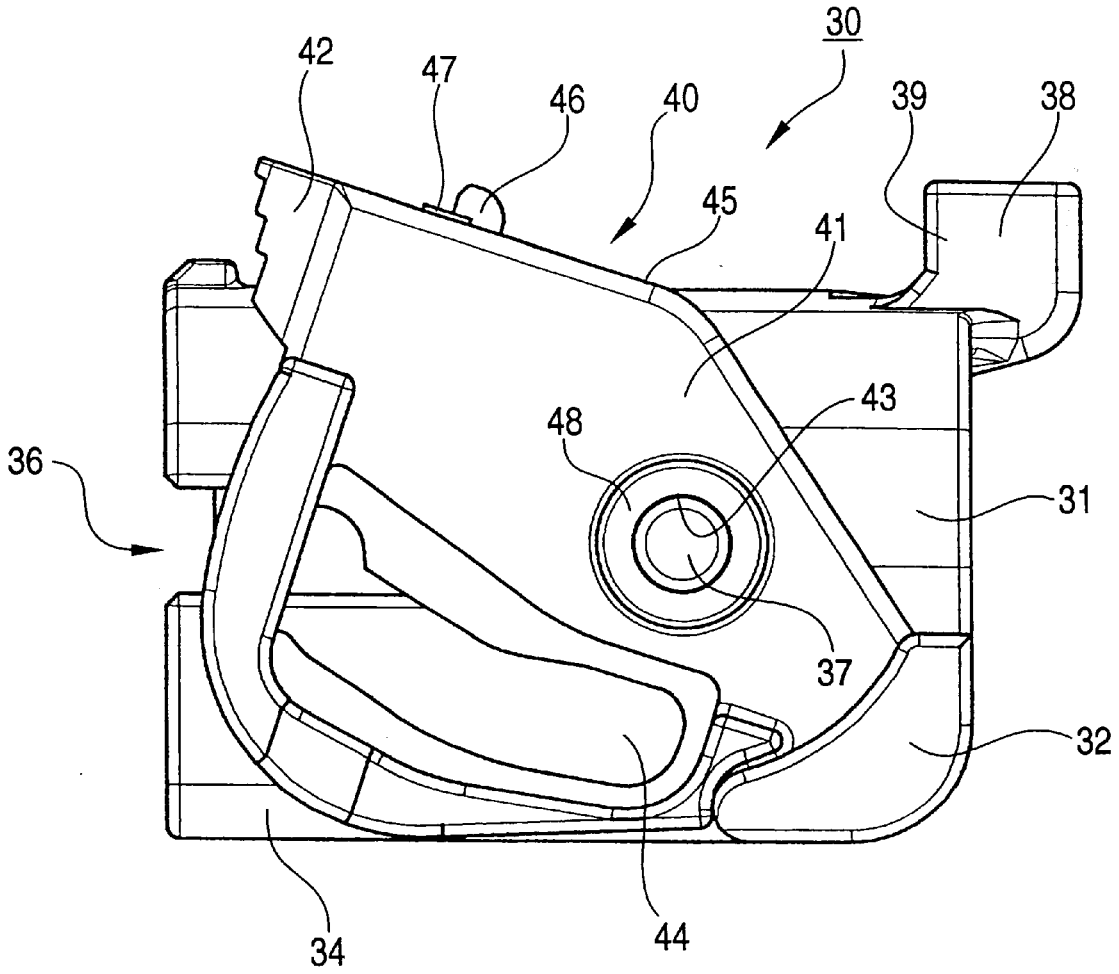
FIG. 2 is a side-elevational view of the connector of FIG. 1.

In the lever type connector 30 of this embodiment, the lever 40 is pivotally mounted on outer walls of the female connector housing 31, as shown in FIGS. 1 and 2.

Figure 5:
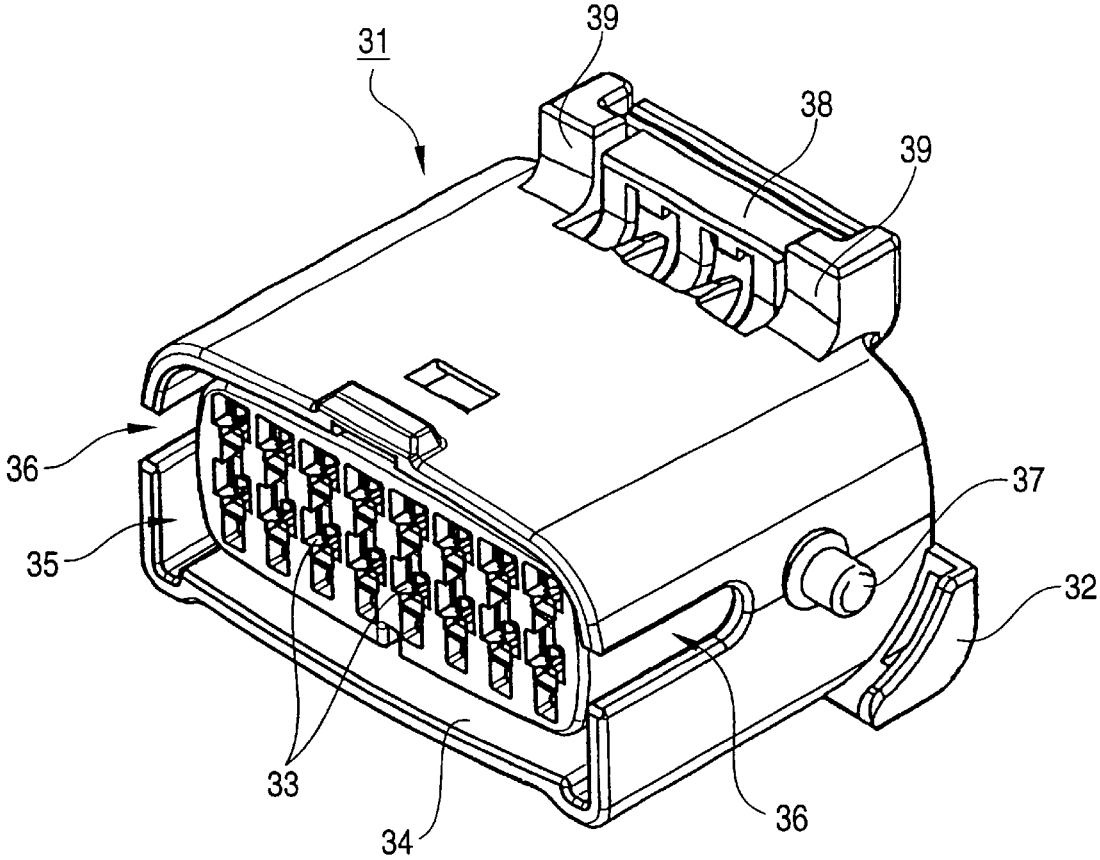
FIG. 5 is a perspective view of a female connector housing in FIG. 1.

As shown in FIG. 5, the female connector housing 31 has a plurality of terminal receiving chambers 33 open to the front side thereof, and its outside is covered with a hood portion 34 which forms a housing-fitting space 35 for receiving the mating male connector housing 20 (see FIG. 7) therein. A pair of boss guide grooves 36 which respectively receive male lever engagement bosses 21 (see FIG. 7) of the male connector housing 20 (described later) are formed respectively in opposite side walls of the hood portion 34, and are open respectively to front ends of these opposite side walls.

A pair of female lever engagement bosses 37 are formed respectively on opposite side walls of the female connector housing 2. Provisionally-retaining portions 32 which provisionally retain one end of the lever 40 before fitting the two connectors together are formed respectively on these opposite side walls, and are disposed near respectively to the female lever engagement bosses 37.

Further, a lever lock portion 38 which retains the lever 40, pivotally moved to completely fit the two connectors together, is formed in an upstanding manner at a rear end portion of the female connector housing 31. Abutting faces 39 are provided in an upstanding manner at opposite sides of the lever lock portion 38, respectively, and jolting prevention projections 47 (described later) are abutted against these abutting faces 39 when the female and male connector housings are completely fitted together.

Figure 6:
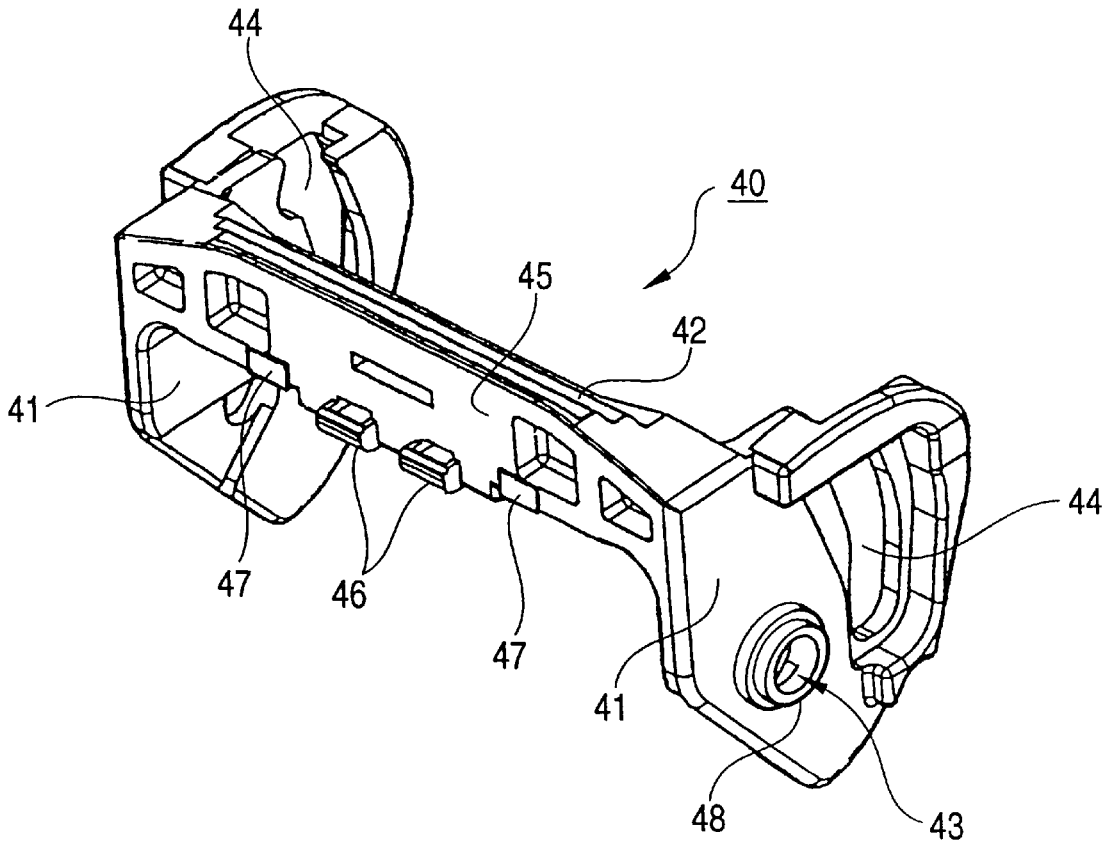
FIG. 6 is a perspective view of a lever in FIG. 1.

As shown in FIG. 6, the lever 40 includes a pair of lever bodies 41 and 41, each having a lever engagement hole 43 which fits on the corresponding female lever engagement boss 37 (see FIG. 5) of the female connector housing 31, and a pivotal movement-operating portion 42 interconnecting these lever bodies. A lever groove portion 44 which guides the corresponding male lever engagement boss 21 (see FIG. 7) during the pivotal movement of the lever is formed in each lever body 41.

A pair of housing lock portions 46 which retain engagement with the lever lock portion 38 are formed in a projected manner on a central portion of an abutment face 45 of the pivotal movement-operating portion 42.

In the lever 40 of this embodiment, the pair of jolting prevention projections 47 are formed on the abutment face 45 of the pivotal movement-operating portion 42, and are disposed respectively at the opposite sides of the pair of housing lock portions 46. This pivotal movement-operating portion 42 can be slightly elastically deformed as a whole when it is brought into retaining engagement with the female connector housing 31.

The cylindrical rib 48 is formed on the outer face of each lever body 41, and is disposed around the entire periphery of the lever engagement hole 43. The height of this cylindrical rib 48 is so determined that the distal end of the female lever engagement boss 37 will not project outwardly from this cylindrical rib 48 when the lever 40 is mounted on the female connector housing 31.

For mounting the lever 40 on the female connector housing 31, the lever 40 is set astride the female connector housing 31, with the female lever engagement bosses 37 fitted respectively in the lever engagement holes 43 of the lever bodies 41, as shown in FIGS. 1 and 2. In this condition, the lever 40 can be pivotally moved about the female lever engagement bosses 37, and an end portion of each lever body 41 is retained by the provisionally-retaining portion 32, so that the lever is provisionally retained relative to the female connector housing 31, with the abutment face 45 of the pivotal movement-operating portion 42 directed upwardly.

Figure 3:
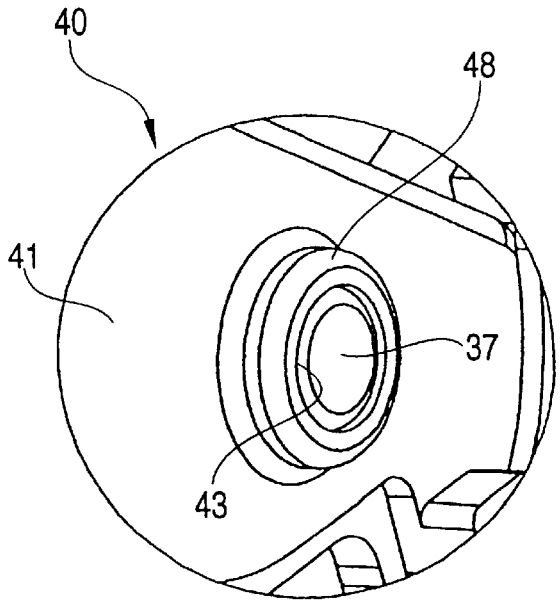
FIG. 3 is a fragmentary, enlarged, perspective view showing a cylindrical rib in FIG. 1.
Figure 4:
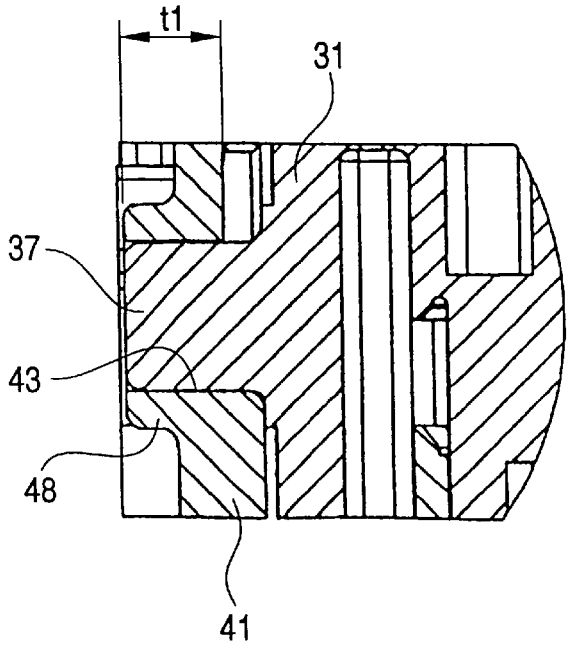
FIG. 4 is a vertical cross-sectional view of that portion of the connector shown in FIG. 3.

The cylindrical rib 48 is formed on the outer face of each lever body 41, and is disposed around the entire periphery of the lever engagement hole 43 as shown in FIGS. 3 and 4, and therefore the peripheral face of the female lever engagement boss 37 is disposed in face-to-face contact with the inner peripheral face of the lever engagement hole 43 over the entire periphery thereof. Namely, a length t1 of contact of the inner peripheral face of the lever engagement hole 43 with the female lever engagement boss 37 is the sum of the wall thickness of the lever body 41 and the height of the cylindrical rib 48.

The distal end of the female lever engagement boss 37 will not project outwardly from the lever engagement hole 43, and therefore the female lever engagement boss 37 will not be cut or shaved during the pivotal movement of the lever 40.

Next, the operation during the fitting connection between the female and male connectors of the lever type connector 30 will be described.

Figure 7:
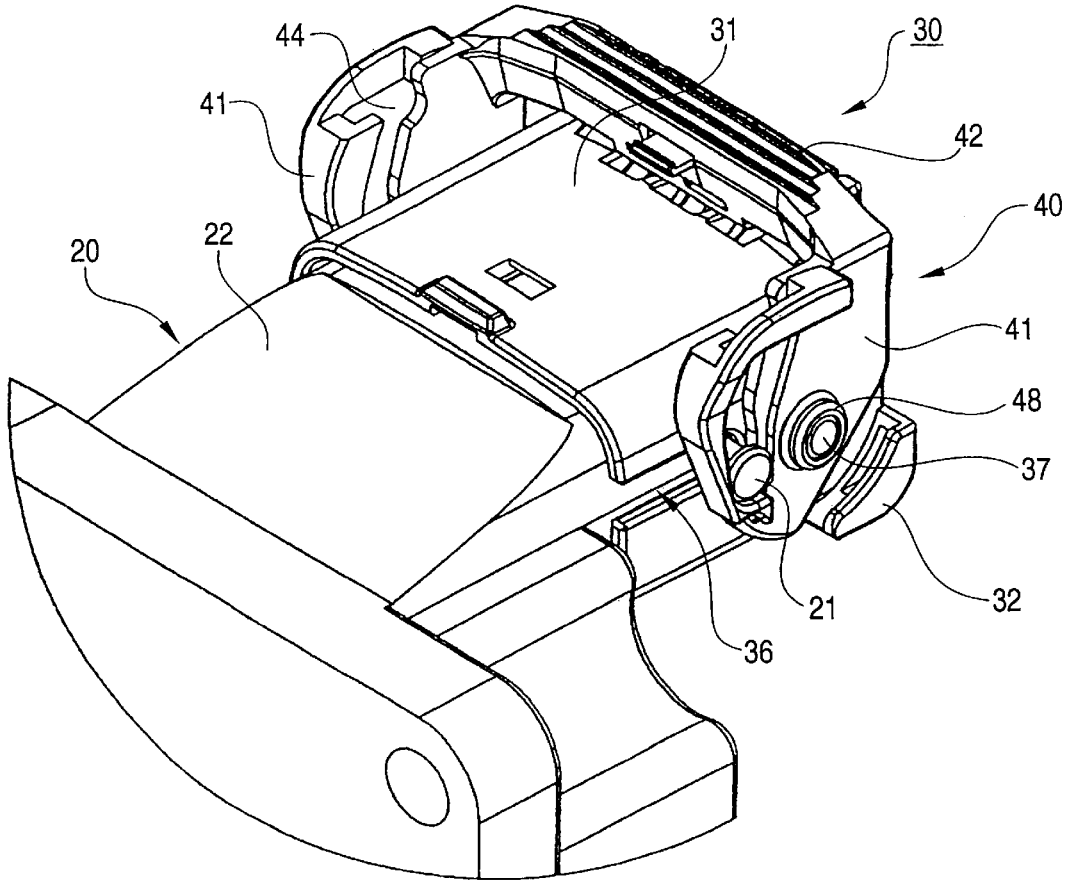
FIG. 7 is a perspective view showing the female and male connector housings in their completely-fitted condition.
Figure 8:
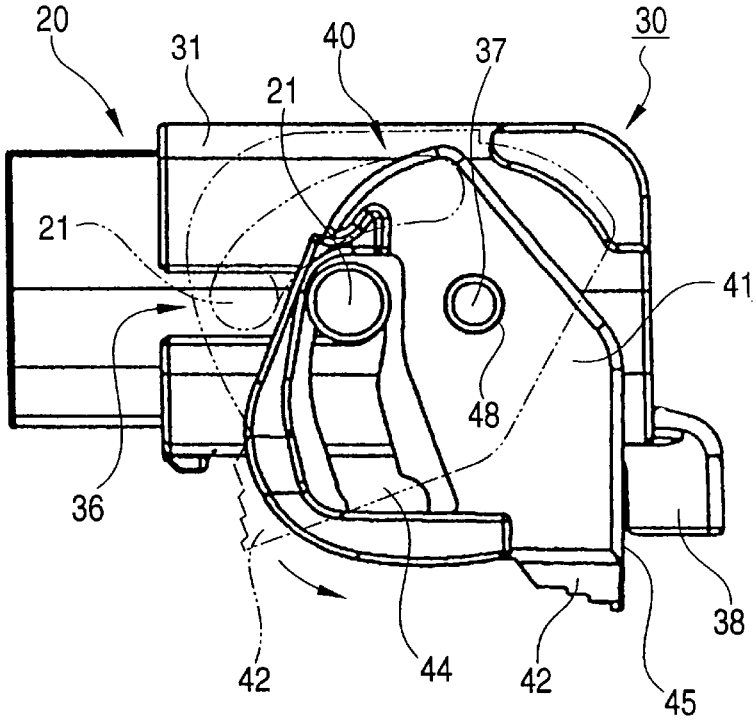
FIG. 8 is a side-elevational view of the two connector housings of FIG. 7.
Figure 9:
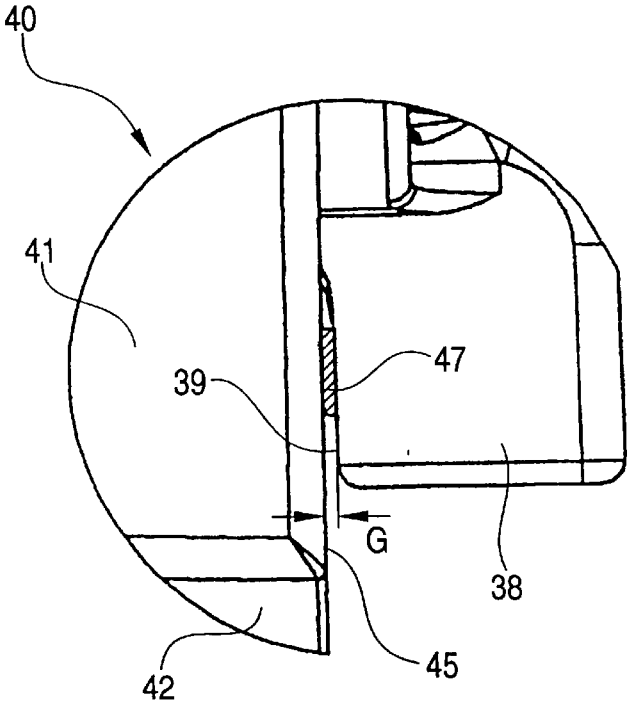
FIG. 9 is an enlarged, perspective view of an important portion in FIG. 8.
Figure 10:
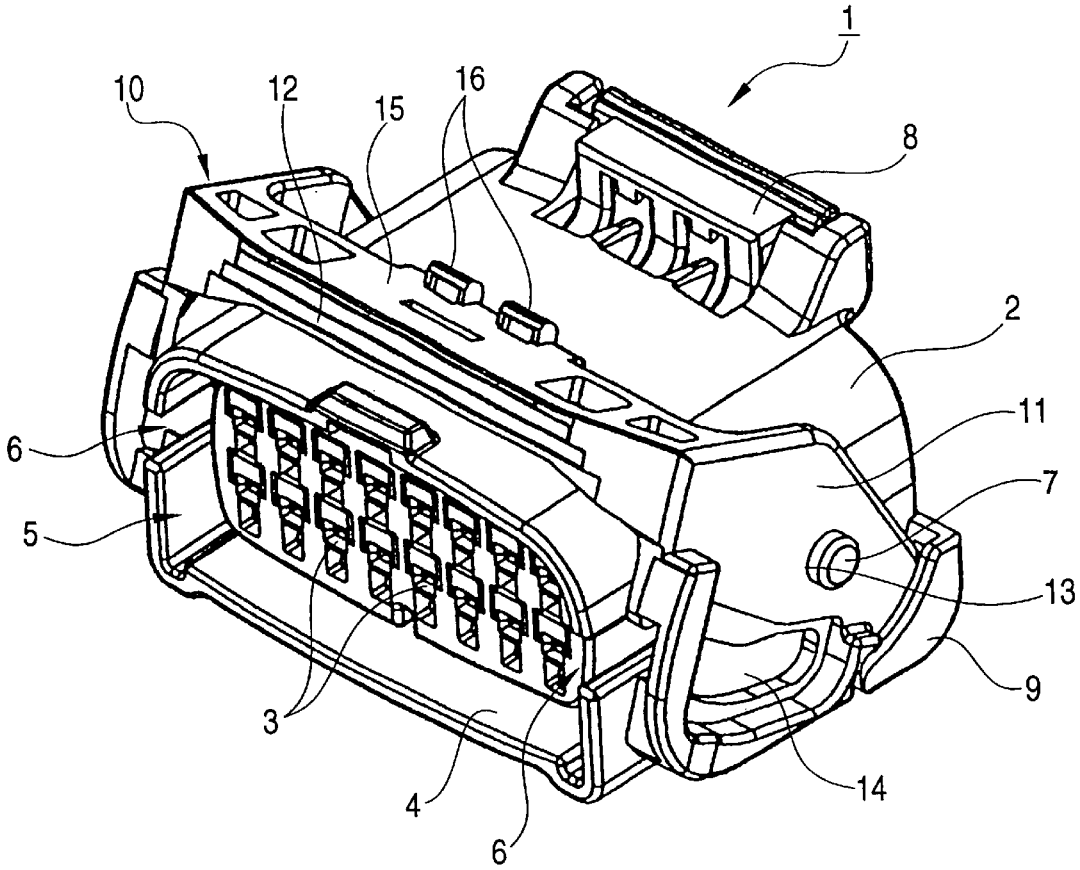
FIG. 10 is a perspective view showing a related lever type connector.
Figure 11:
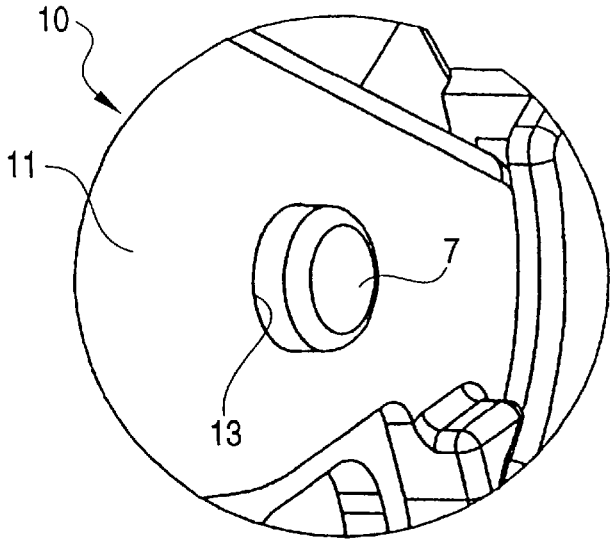
FIG. 11 is a fragmentary, enlarged view showing a lever engagement boss in FIG. 10.
Figure 12:
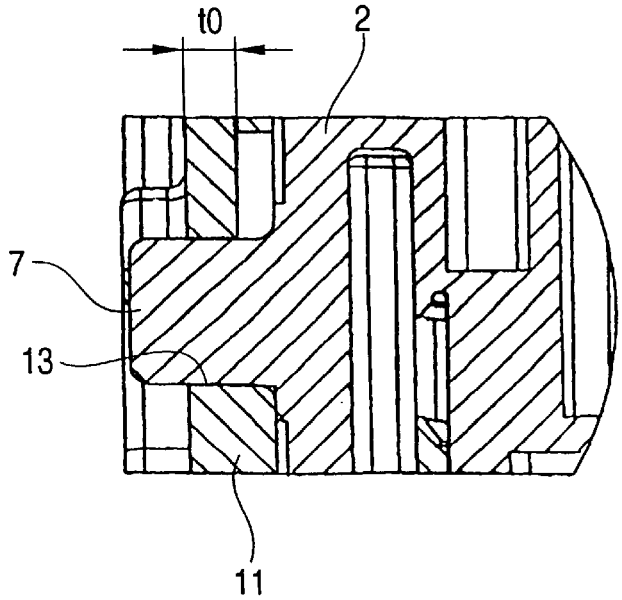
FIG. 12 is a vertical cross-sectional view that portion of the connector shown in FIG. 11.
Figure 13:
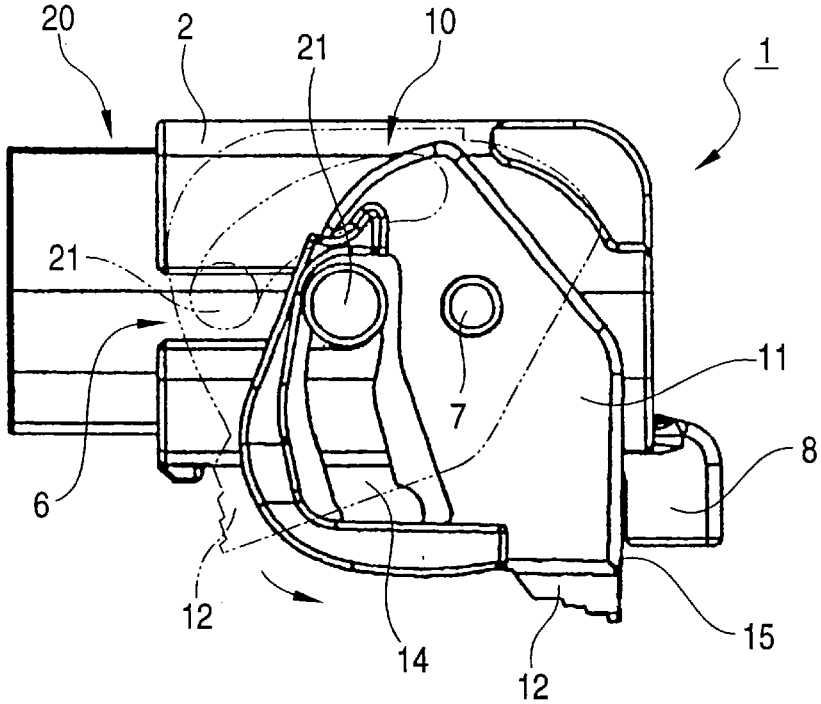
FIG. 13 is a side-elevational view showing female and male connector housings of the related connector in their completely-fitted condition.
Figure 14:
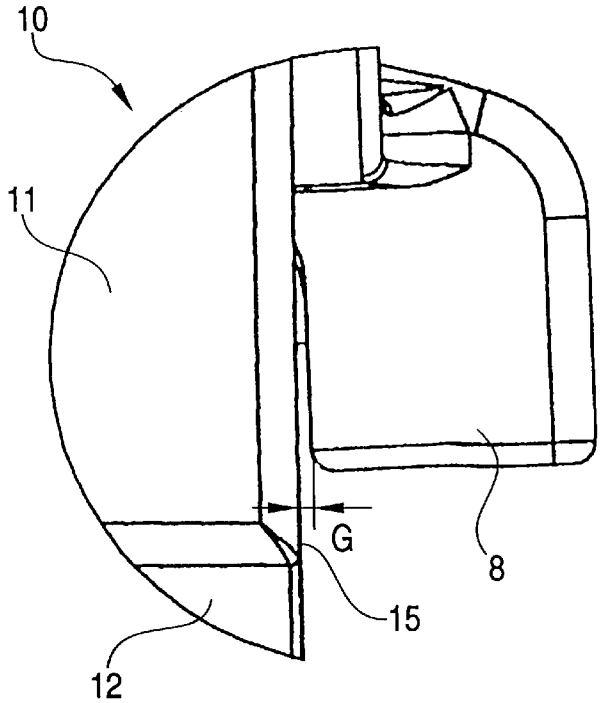
FIG. 14 is an enlarged, perspective view of an important portion in FIG. 13.

The fitting sides of the female and male connector housings 31 and 20 are opposed to each other, and the male lever engagement bosses 21 of the male connector housing 20 are inserted respectively into the boss guide grooves 36, and are slidably engaged respectively in the lever groove portions 44 in the lever 40, as shown in FIGS. 7 and 8.

Then, the pivotal movement-operating portion 42, indicated in imaginary lines, is gripped, and is pivotally moved about the female lever engagement bosses 37 toward the lever lock portion 38 (in a direction of an arrow B in the drawing). As a result, in accordance with this pivotal movement, each male lever engagement boss 21 of the male connector housing 20 moves toward the inner end of the lever groove portion 44, and also moves toward the inner end of the boss guide groove 36 in the female connector housing 31.

In accordance with this movement of the male lever engagement bosses 21, the male connector housing 20 is inserted and fitted into the housing-fitting space 35 in the female connector housing 31, and therefore the fitting of the female and male connector housings 31 and 20 relative to each other proceeds.

Then, the abutment face 45 of the pivotal movement-operating portion 42 of the lever 40 abuts against the lever lock portion 38 as shown in FIG. 8, and the housing lock portions 46 (see FIG. 1) are retained by this lever lock portion, so that the female and male connector housings 31 and 20 are completely fitted together.

At this time, the jolting prevention projections 47 on the abutment face 45 are abutted respectively against the abutting faces 39 of the lever lock portion 38, so that the pivotal movement-operating portion 42 of the lever 40 is elastically deformed convexly toward the lever lock portion 38. Therefore, the lever 40 can be retained with a suitable urging force even without the use of any spring.

And besides, the jolting prevention projection 47 exists in the gap between the abutment face 45 of the pivotal movement-operating portion 42 and each abutting face 39 of the lever lock portion 38, and therefore the jolting due to vibrations or the like can be positively prevented.

Furthermore, when releasing the retained condition of the lever 40, the lever 40 is sprung up by the resilient force of the elastically-deformed pivotal movement-operating portion 42, and therefore the operability for releasing the retained condition of the lever can be enhanced.

What is claimed is:

1. A lever type connector comprising:

a first housing;

a second housing;

a lever, provided on the second housing so as to be pivotable between a first position and a second position, the lever comprising a pair of lever bodies and a lever connecting portion connecting the pair of lever bodies;

a lever retainer, provided on the second housing to retain the lever at the second position; and a first boss, provided on at least one of the lever connecting portion and the lever retainer;

wherein the first housing and the second housing are fitted with each other in a leverage manner when the lever is pivoted toward the second position; and wherein at least one of the lever connecting portion and the lever retainer is flexed by the first boss in a state that the lever is retained on the lever retainer when the first housing and the second housing are completely engaged.

2. The lever connector as set forth in claim 1, wherein the lever further comprises a lock portion for engaging the lever retainer to retain the lever at the second position.

3. The lever connector as set forth in claim 1, wherein the first boss is a jolting prevention projection for preventing movement between the first housing and the second housing.

4. The lever connector as set forth in claim 1, wherein the first boss urges the lever connecting portion and the lever retainer away from each other.

5. The lever connector as set forth in claim 1, wherein the first boss fills a gap between opposing surfaces of the lever connecting portion and the lever retainer.

6. The lever connector as set forth in claim 1, wherein the first boss elastically deforms the lever connecting portion and urges the lever retainer away from an opposing surface of the level connecting portion for enhancing the releasability of the lever from the lever retainer.

7. The lever connector as set forth in claim 1, wherein the first boss abuts an opposing surface of at least one of the lever connecting portion and the lever retainer.

8. The lever connector as set forth in claim 7, wherein the first boss elastically deforms the lever connecting portion convexly toward the lever retainer.

9. The lever connector as set forth in claim 1, further comprising:

a second boss formed on each of both side walls of the second housing; and wherein each of the lever bodies has a first engagement hole; and wherein each of the lever bodies has a cylindrical supporting portion formed around the first engagement hole so as to cover a peripheral wall of the second boss protruded outwardly through the first engagement hole.

10. The lever connector as set forth in claim 9, wherein a distal end of the second boss is flush with a surface of the lever bodies for preventing a surface of the engagement hole from cutting or shaving of the second boss during pivotal movement of the lever.

* * * * *